US005779514A

United States Patent [19]

Cheng et al.

[11] Patent Number: 5,779,514

[45] Date of Patent: Jul. 14, 1998

[54] TECHNIQUE TO FABRICATE CHIMNEY-SHAPED EMITTERS FOR FIELD-EMISSION DEVICES

[75] Inventors: Huang-Chung Cheng, Hsin-Chu; Chih-Chong Wang, Chang Hua, both of Taiwan

[73] Assignee: National Science Council, Taipei, Taiwan

[21] Appl. No.: 601,153

[22] Filed: Feb. 13, 1996

[51] Int. Cl.[6] ..... H01J 9/02

[52] U.S. Cl. ..... 445/24; 445/50

[58] Field of Search ..... 445/24, 50

[56] References Cited

U.S. PATENT DOCUMENTS 5,145,435 9/1992 Ayers ..... 445/24

5,199,917 4/1993 MacDonald et al. ..... 445/50 X 5,643,032 7/1997 Cheng et al. ..... 445/50 X

*Primary Examiner*—Kenneth J. Ramsey

*Attorney, Agent, or Firm*—Bacon & Thomas

[57] ABSTRACT

A new fabrication technology for the chimney-shaped metal field emission elements with a self-alignment process which makes the emitter structure symmetrical. This tectnology is based on the isotropic or anisotropic, wet or dry etching and then the sputtering deposition of the emither material as well as the wet etching of attaching silicon. The finished field emitters are with excellent uniformity and high reproducibility and are able to emit the current thirty times in magnitude higher than that from the conventional cone-shaped field emitters at the same electric field.

12 Claims, 4 Drawing Sheets

TECHNIQUE TO FABRICATE CHIMNEY-SHAPED EMITTERS FOR FIELD-EMISSION DEVICES

BACKGROUND OF THE INVENTION

1. Field of the Invention

The present invention relates to the procedures of fabricating vacuum microelectronic element technology. By this technology the finished emitter material structure will be uniform due to a self alignment process.

2. Description of the Prior Art

The field emission devices are first developed and presented by C. A. Spindt in 1969 and have been wildly applied in the field of vacuum microelectronic element. Their superiority in emitting speed, operation under high frequencies, enduring the severe surroundings and sensitivity to temperature compared to the traditional solid state electronic elements makes them possess the promising future in the application fields of flat panel displays, high-frequency microelectronic elements, electronic microscopes, high power electron tubes, micro detecting devices and amplifiers. The producing methods for field emission elements mainly have the following two kinds: One is metal tip deposition by evaporation which was developed by Mr. Spindt and the other one is semiconductor technique by applying very large scale interation (VLSI) technology associated with micro machining technique.

To produce field emission elements by metal film deposition by evaporation usually has two shortcomings: First, metal film deposition for cone shaped emitting formation through oblique and vertical evaporation by rotating substrate are particularly necessary, but such ways of film deposition are incompatible with the VLSI technology and extravagantly expensive equipment will be required which adds complication and difficulty in manufacturing processes. Second, the uniform covering through a large area is not an easy matter.

Although the uniform covering through a large area may be comparatively acquired by the VLSI technology associated with micro machining technique, yet the emission element made of silicon is subjected to surface molecular absorption or desorption and the oxidation effect, it has a tendency to become unstable and attenuating. If using this silison emitter and employing low work-function metal as the emitter material, the above mentioned phenomena may be avoided, but the technique of self-alignment process will be not applicable, the problem of complication and difficulty in manufacturing still exist.

SUMMARY OF THE INVENTION

A new fabrication technology for the chimney-shaped metal field emission elements of the present invention presents a novel method which can correct the above mentioned shortcomings. This technology is based on the isotropic or anisotropic, wet or dry etching and then the sputtering deposition of emitter material, deposition of the insulation layer and the gate metal, as well as the wet etching of attaching silicon wafer. Only one mask is used for the entire process which greatly simplifies the processes and increase the possibility of mass production. The expensive advanced photolithographic equipment is not required, and the finished emitter may be made of various kinds of low work-function materials. Also the chimney-shaped field emitters of the present invention has more emitting sites and mutual compensating effect than the conventional ones, it emits the current thirty times in magnitude higher than that from the conventional cone-shaped field emitters at the same electric field, and it also has more significantly improved stability compared to the conventional field emitters.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
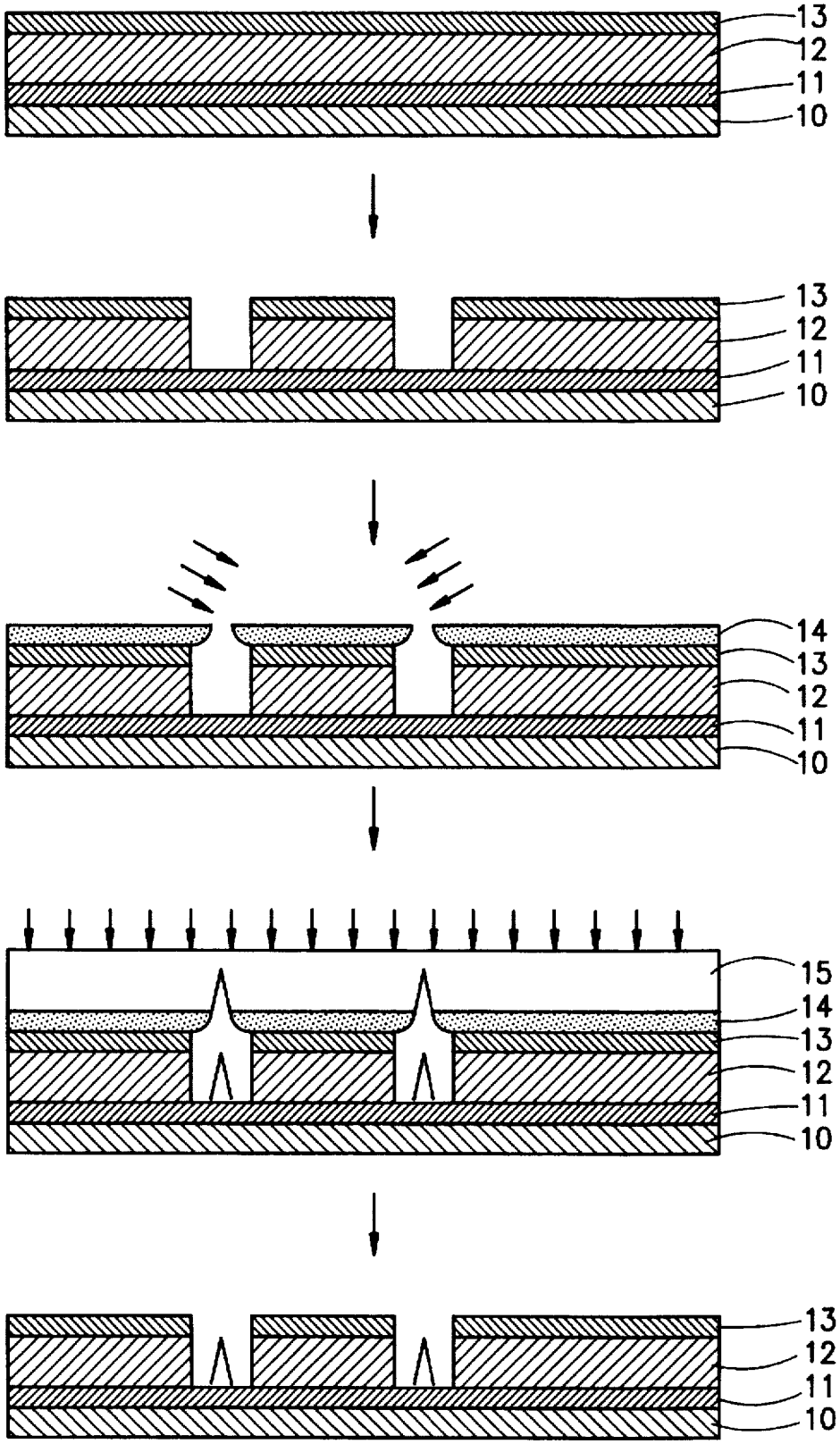
FIG. 1 (PRIOR ART)
FIG. 1 shows the conventional metal tip deposition process by evaporation.

Referring to FIG. 1, the making technology of the conventional metal evaporation consists of five independent processes:

(1) A cathode metal conductor 11 is deposited with a metal film by evaporation on a silicon substrate at the first, and immediately after that a insulating layer material 12, a gate metal deposition 13 are formed respectively;
(2) A hole is formed by etching, in this case the material for the cathode metal conductor 11 shall be so selected that it is of the anti-etching characteristic;
(3) A sacrificing layer 14 is formed by obliquely depositing a metal film on the gate metal surface by evaporation, the angle of oblique deposition shall be kept approximately larger than 70° to enhance the attachment of the sacrificing layer 14 and assure the forming of the cone emitters.
(4) The cone-shaped metal emitter is formed by evaportion in the normal direction to the substrate, the diameter of the hole will become smaller and smaller and finally completely closed to form a cone-shaped metal emitter during the evaporation.
(5) Removing the sacrificing layer 14 by lifting off technology, the cone-shaped metal emitters are exposed to form field emission elements.

Figure 2:
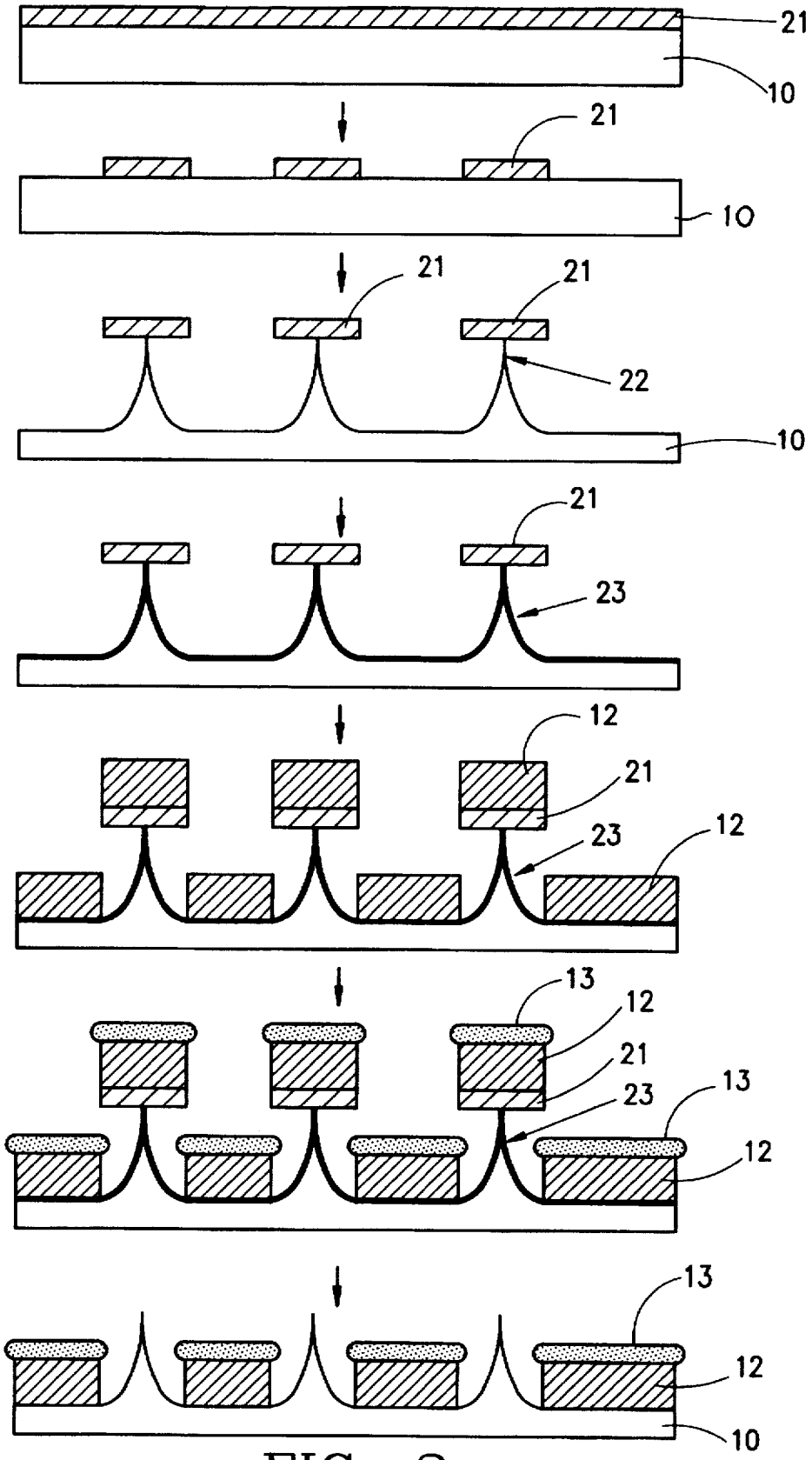
FIG. 2 (PRIOR ART)
FIG. 2 shows the general making processes of field emission elements of a silicon emitter.

Referring to FIG. 2, a general making technology of field emission elements of a silicon emitter consists of the following independent processes;

(1) Silicon dioxide ($SiO_2$) grows on a silicone substrate 10 forming a mask for the sillsion etching.
(2) A silicon dioxide mask 21 is formed using the bufferal etchant (BOE).
(3) A silicon cone neck 22 is formed by means of the isotropic or anisotropic, wet or dry etching, the width of the cone neck 22 is 1000–2000 Å in general.
(4) To sharpen the silicon cone neck 22 by growing silicon dioxide 23 using low temperature heat oxidation technique.
(5) A insulating material 12 is deposited by evaporation to isolate the gate metal 13 and cathode,
(6) Forming the gate metal 13 by metal evaporation.
(7) To remove silicon dioxide 23 with Buffer HF solution; at this time the silicon dioxide mask 21 is lifted-off simultaneously and thus the silicon cone is exposed to form a field emission element.

As shown in the above mentioned processes (3) and (4) of FIG. 1, this technology is not compatible with the present VLSI requirements owing to the difficulty encountered in metal deposition by evaporation for cone formation as well as oblique deposition with rotating substrate. However, the second technology described on FIG. 2 may be able to overcome the shortcomings of those mentioned on FIG. 1, but the latter can not make use of low work-function material and consequently the power loss of the whole element will be increased owing to greater turn-on voltage and operating voltage.

Figure 3:
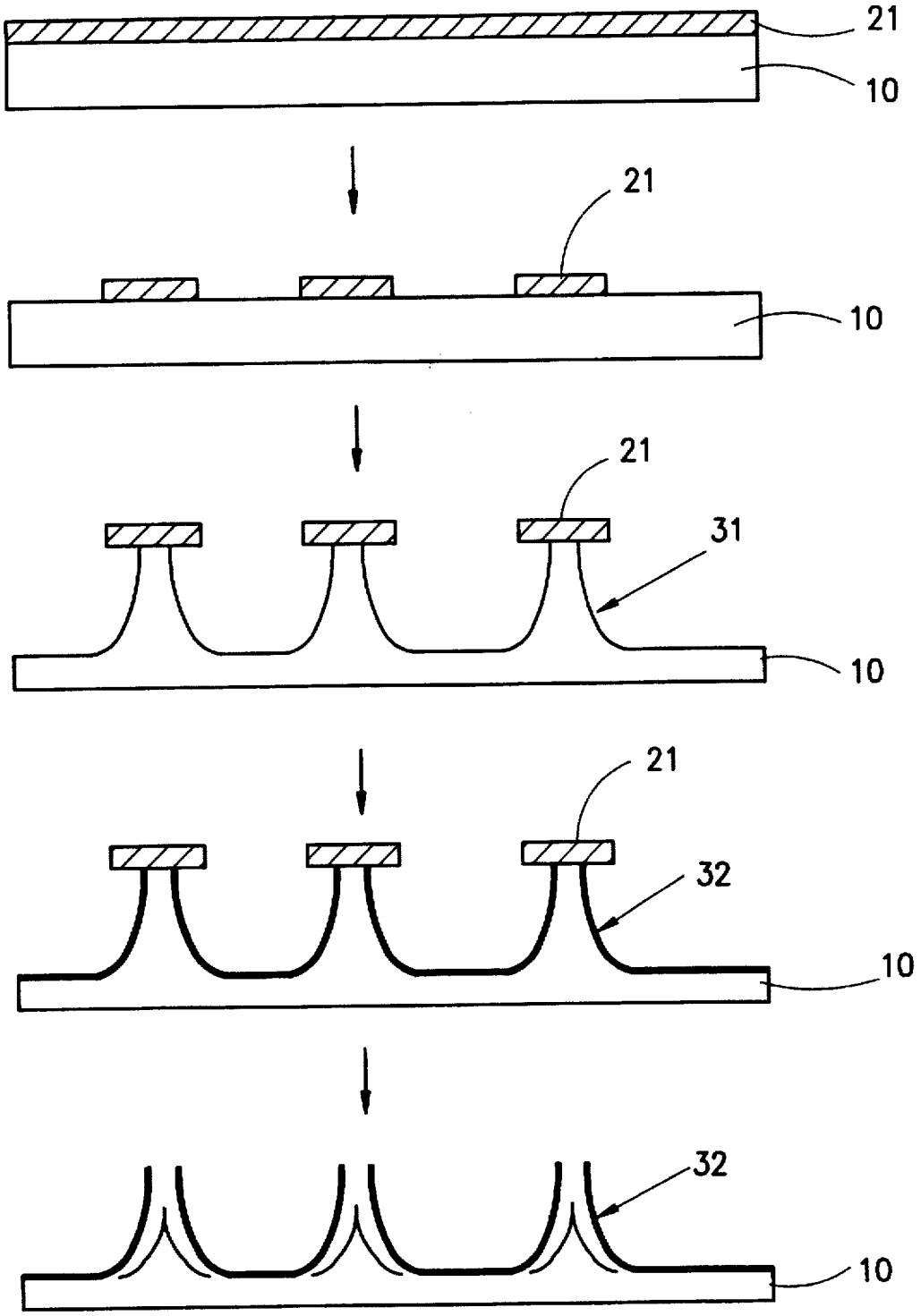
FIG. 3 shows the making processes of a chimney-shaped field emitters of a diode by the method of the present invention.

In order to overcome the above mentioned shortcomings, this invention presents a feasible innovating fabrication technology which can be divided into two procedures, one for fabricating diodes, and the other one for triodes, the detail descriptions of each procedure is enumerated as follows:

Referring to FIG. 3, this shows a novel fabrication technology for the chimney-shaped metal field emission diode which consists of five processes:

(1) A layer of silicon dioxide grows on the silicon substrate 10 at first, it has two function: 1, it works as a mask when etching the silicon substrate 10, and 2, it works as a mask when depositing the low work-function material by sputtering, the combined result of both two functions leads to successful fabrication of chimney-shaped field emission elements.

(2) A silicon dioxide mask 21 is formed using photolithographic etching method.

(3) A narrow neck silicon cone 31 is formed by means of the isotropic or anisotropic, wet or dry etching, the diameter of the neck can be adjusted so that it is possible to make the chimney-shaped field emission elements of any size.

(4) For depositing low work-function material 32, by physical vapor deposition method may be employed, it is a preferable method due to isotropic characteristic of sputtering so that the vapor molecules will easily spread in entire reactor so that more perfect deposition of the sputting material may result, it also shows the fact that the field emission element has more perfect structure which is corresponding to triode requirements under forming. Depositing by means of electron gun is also feasible, but the smaller aspect ratio of the field emission element will result. Nevertheless as for the fabrication on field-emission diodes there are no essential differences will be observed.

(5) To etch the silicon substrate 10 around the narrow neck with the solution, which is able to etch polycrystalline silicon, this narrow neck still supports silicon dioxide mask 21. Due to the fact that this solution contains the component which can etch silicon dioxide, the part of silicon dioxide which is not yet deposited with low work-function material will be etched first. Owing to the speed of etching silicon is substantially than that of etching silicon dioxide, the solution will contact the narrow neck silicon immediately after the silicon dioxide substrate on the narrow neck is etched and there appears clearance, and the narrow neck silicon supporting the mask will be etched in no time at all. Consequently, being lost the support, silicon dioxide will entirely lift-off, and there exposes the chimney-shaped field emission element 32 accomplishing the forming of a diode.

The solutions of nitric acid ($HNO_3$), acetic acid ($CH_3COOH$), hydrogen fluoride (HF) and ammonium fluoride ($NH_4F$) are used to etch the supporting silicon neck and lift-off the silicon dioxide mask, expose the field emission element thus accomplishing the forming of the field emitter.

The finished emitter materials are low work-function materials such as chromium (Cr), metal silicide, diamond, tungsten (W), molybdenum (Mo), hafnium (Hf), titanium (Ti), platinum (Pt), palladium (Pd), titanic tungsten (TiW), and carborundum (SiC).

Diamond is a preferred low work-function material.

Figure 4:
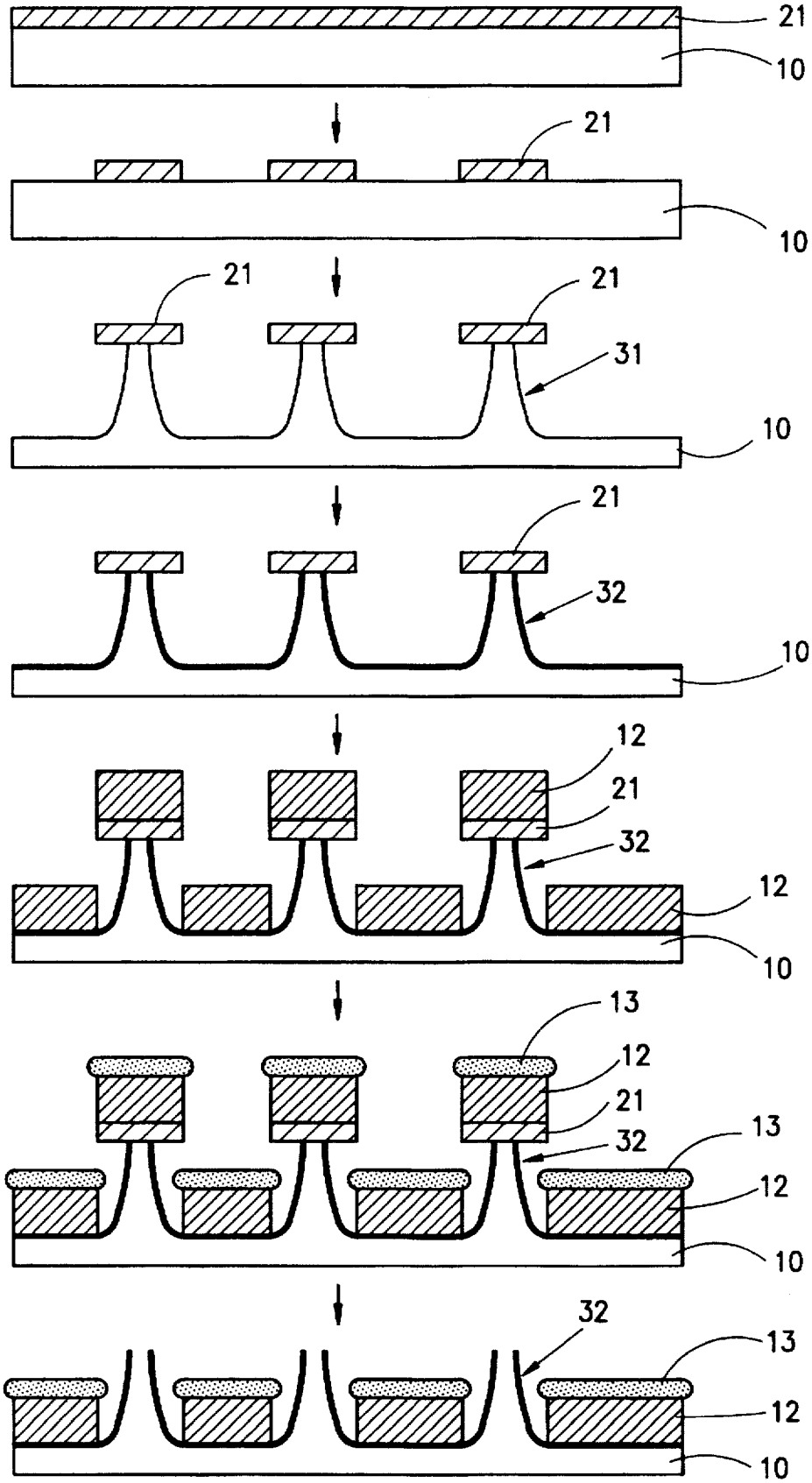
FIG. 4 shows the making processes of a chimney-shaped field emitters of a triode by the method of the present invention.

Referring to FIG. 4, this shows a novel fabrication technology for chimney-shaped metal field emission triode in which consists of the following processes that:

From process (1) to process (4) is entirely identical as that for fabricating a diode, (5) Forming a insulation layer 12 by evaporation ordeposition. This can be accomplished by means of physical vapor deposition technology, it may be accomplished by electron gun evaporation. This also can be accompplished by menus of chamical vapor technoloy, it may be accomplished by plasma enhancement chemical vapor deposition (PECVD) technology. If the emitter has a higher aspect ratio, the insulation layer may be evaporated thicker and the entire capacitance can be reduced which is advantageous to improve high frequency characteristics.

(6) This is a making process for the metal gate electrode 13 which can be accomplished by physical vapor deposition technology. Due to the better anisotropiccharacteristic of the electron gun evaporation, the gate metal may symmetrically cover on silicon dioxide. This gate metal 13 may be formed of various metals possessing anticorrosive property to buffer HF solution such as Cr, W, Mo, TIW, etc. with thickness approximately 1500 Å–2000 Å

(7) Use the solution for etching polycry stallial silicon to etch the silicon substrate 10 around the narrow neck, this narrow neck still supports the silicon dioxide mask 21. Due to the fact that this solution contains the component which may etch silicon dioxide 23, the part of silicon dioxide 23 which is not covered with low work-function material will be etched first. Owing to the speed of etching silicon substrate is substantially greater than that of etching silicon dioxide, the entire silicon dioxide mask 21 will lift-off when the silicon substrate 10 around the narrow neck used as a support has been etched out exposing the chimney-shaped field emission element 32.

In conclusion, the present invention possesses the following prominent features:

1. Fully compatible with the making processes of existing VLSI.
2. No requirement for the advanced expensive lithography equipment.
3. Only one mask is required in entire making processes which greatly simplifies the making processes and increases the possibility of mass production.
4. The finished field emitter is made of low work-function material.
5. The technology of the present invention possesses the self-alignment characteristic so that the finished field emitter structure is symmetrical and it emits the current thirty times in magnitude higher than that from the conventional cone-shaped field emitter at the same electric field. Its emitting positions distributing in circular figure have the mutual compensating function which greatly increases short-term and long-term stabiity Many changes and modifications in the above described embodiment of the invention can, of course be carried out without departing from the scope thereof. Accordingly, to promote the progress in science and the useful arts, the invention is disclosed and is intended to be limited only by the scope of the appended claims.

What is claimed is:

1. A method for making chimney-shaped metal field emission elements which comprises:

(a) growing a layer of silicon dioxide on a silicon substrate;

(b) forming a silicon dioxide mask using photolithographic etching on the silicon substrate;

(c) forming a narrow neck silicon cone by means of isotropic or anisotropic wet or dry etching, the silicon dioxide mask on said cone remaining connected to said cone;

(d) sputtering a low work-function material on said unmasked areas by isotropic physical vapor deposition;

(e) etching the silicon dioxide with a solution which is able to etch silicon dioxide and silicon to form the chimney-shaped field emission element forming a diode.

2. A method as claimed in claim 1 wherein any one of sputtering, evaporating or chemical vapor deposition technology is employed for forming the field emitter.

3. A method as claimed in claim 1 wherein sputtering and selective chemical vapor deposition technology are used for forming the field emitter.

4. A method as claimed in claim 1 wherein the solutions of nitric acid ($HNO_3$), acetic acid ($CH_3COOH$), hydrogen fluoride (HF) and ammonium fluoride are used to etch the supporting silicon neck and lift-off the silicon dioxide mask, to expose the field emission element thus forming the field emitter.

5. A method as claimed in claim 1 wherein the finished emitter materials are low work-function materials such as chromium (Cr), metal silicide, diamond, tungsten (W), molybdenum (Mo), hafnium (Hf), titanium (Ti), platinum (Pt), palladium (Pd), titanic tungsten (TiW), and carborundum (SiC).

6. A method as claimed in claim 5 wherein the finished emitter materials are diamond.

7. A method for making chimney-shaped metal field emission elements which comprises:

(a) growing a layer of silicon dioxide on a silicon substrate;

(b) forming a silicon dioxide mask using photolithographic etching on the silicon substrate;

(c) forming a narrow neck silicon cone by means of isotropic or anisotropic wet or dry etching, the silicon dioxide mask on said cone remaining connected to said cone;

(d) sputtering a low work-function material on said unmasked areas by isotropic physical vapor deposition;

(e) forming an insulation layer by evaporation or deposition;

(f) forming a gate metal layer by physical vapor deposition; and (g) etching the silicon dioxide with a solution which is able to etch silicon dioxide and silicon to form the chimney-shaped field emission element forming a triode.

8. A method as claimed in claim 7 wherein any one of sputtering, evaporating or chemical vapor deposition technology is employed for forming the field emitter.

9. A method as claimed in claim 7 wherein sputtering and selective chemical vapor deposition technology are used for forming the field emitter.

10. A method as claimed in claim 7 wherein the solutions of nitric acid ($HNO_3$), acetic acid ($CH_3COOH$), hydrogen fluoride (HF) and ammonium fluoride are used to etch the supporting silicon neck and lift-off the silicon dioxide mask, expose the field emission element thus forming the field emitter.

11. A method as claimed in claim 7 wherein the finished emitter materials are low work-function materials such as chromium (Cr), metal silicide, diamond, tungsten (W), molybdenum (Mo), hafnium (Hf), titanium (Ti), platinum (Pt), palladium (Pd), titanic tungsten (TiW), and carborundum (SiC).

12. A method as claimed in claim 11 wherein the finished emitter materials are diamond.

* * * * *